United States Patent [19]

McCusker

[11] Patent Number: 4,607,640

[45] Date of Patent: Aug. 26, 1986

[54] ATHLETIC/INDUSTRIAL BRASSIERE WITH PROTECTIVE INSERTS

[76] Inventor: LeRoy H. McCusker, R.R. 4, Box 162, Cannon Falls, Minn. 55009

[21] Appl. No.: 799,091

[22] Filed: Nov. 18, 1985

[51] Int. Cl.[4] ..... A41C 3/00

[52] U.S. Cl. ..... 128/425; 128/463

[58] Field of Search ..... 128/425, 463; 2/2

[56] References Cited

U.S. PATENT DOCUMENTS

| | | | |
|---|---|---|---|
| 1,721,739 | 7/1929 | Kennedy | 2/2 |
| 2,445,767 | 7/1948 | Dickerson | 128/46 |
| 2,468,841 | 5/1949 | Siegel | 2/2 |
| 2,495,307 | 1/1950 | Abramson | 128/150 |
| 3,176,686 | 4/1965 | Barnes | 128/132 R |
| 3,225,768 | 12/1965 | Galitzki et al. | 128/463 |
| 3,310,053 | 3/1967 | Greenwood | 128/577 |
| 3,478,739 | 11/1969 | Librande | 128/132 R |
| 3,526,221 | 9/1970 | Garber | 128/95 |

*Primary Examiner*—Doris L. Troutman

*Attorney, Agent, or Firm*—Merchant, Gould, Smith, Edell, Welter & Schmidt

[57] ABSTRACT

A protective brassiere and protective inserts therefor are disclosed. The brassiere is provided with thin pockets formed from two layers of fabric with a lateral access opening to receive the insert. The insert has a concave central portion that is substantially rigid with peripheral portions that are flexible in part. The central rigid portion is capable of withstanding forces of impact and transmitting them to the user's thoracic cage through the more flexible portions. In an alternative embodiment, an article of clothing is disclosed which includes similar thin pockets that are accessible internally of the article to receive and hold inserts of the same configuration. The inserts used with the clothing article are intended to provide a supportive more than a protective function, and to that end the central portion of each insert is semiflexible and the peripheral portion is flexible.

24 Claims, 11 Drawing Figures

FIG. 1
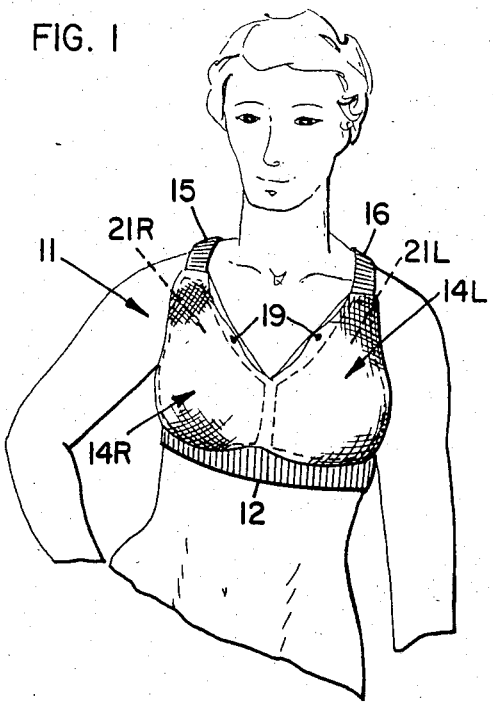
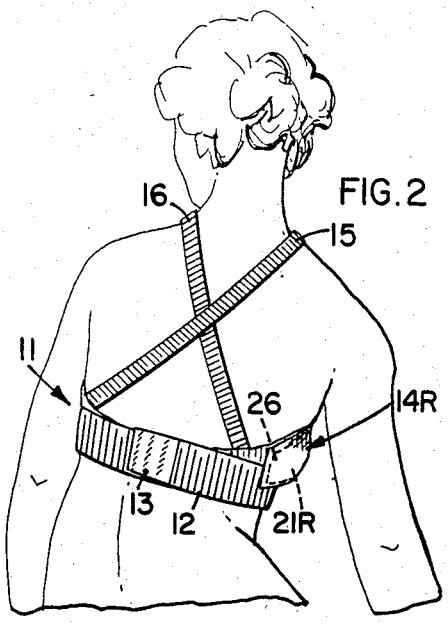
FIG. 2
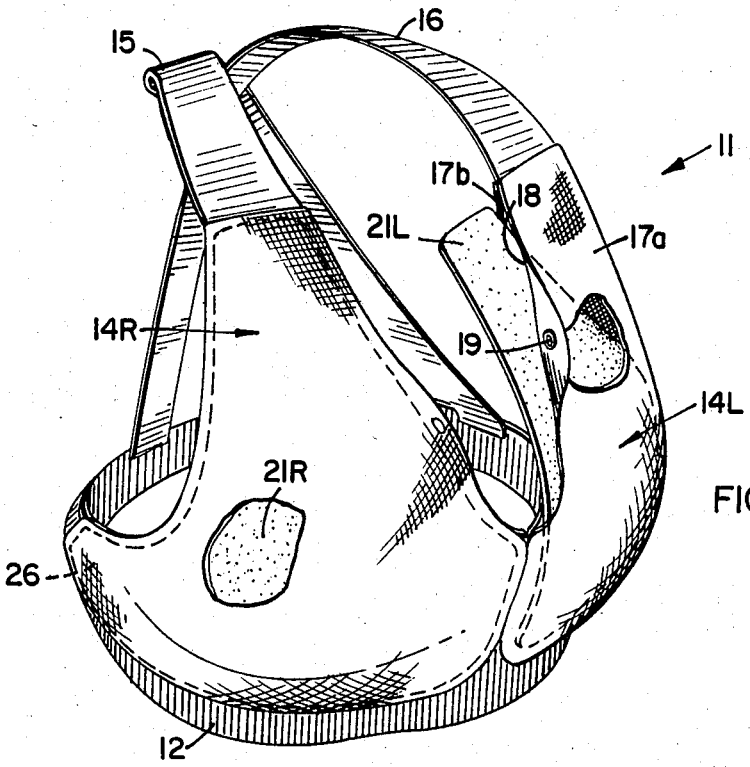
FIG. 3

FIG. 4
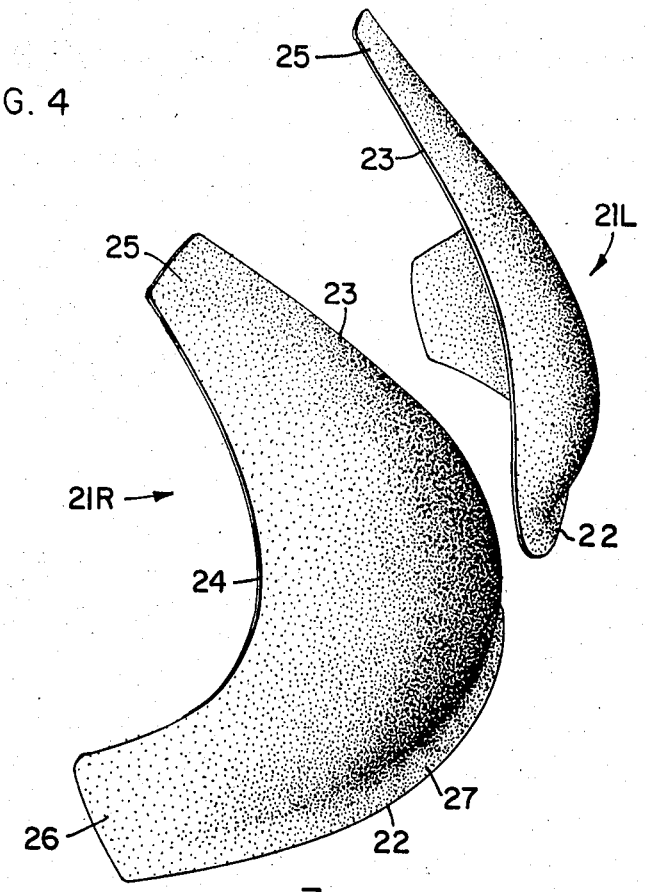
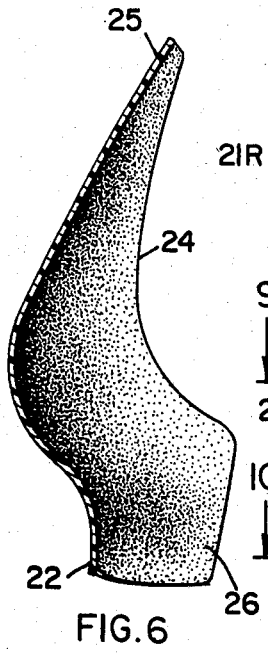
FIG. 6
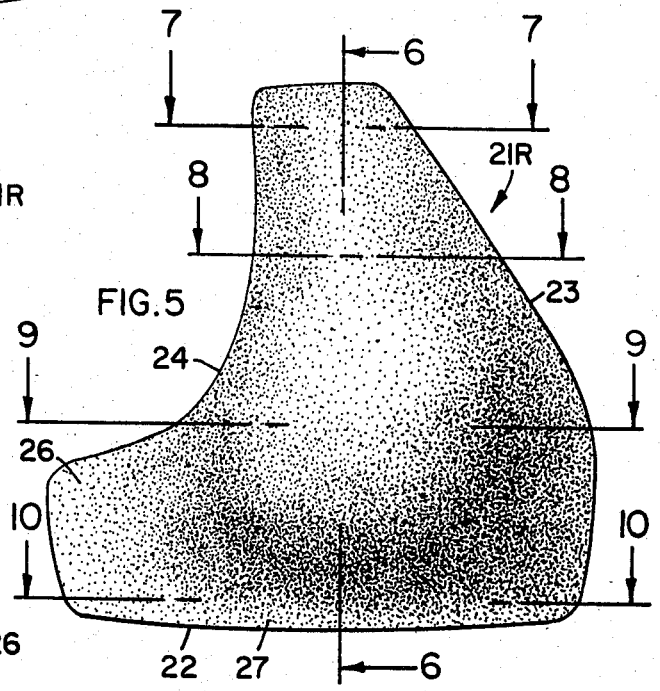
FIG. 5

ATHLETIC/INDUSTRIAL BRASSIERE WITH PROTECTIVE INSERTS

The invention is directed to a protective and supportive brassiere particularly suited to athletic and industrial use.

Over the past two decades, women have become increasingly involved in many types of athletics, and there has also been a substantial trend to body fitness through exercise classes, jogging, aerobics, muscle toning and strengthening equipment and related activities. Many sporting events involve body contact that may become extreme in some instances (e.g., rebounding in basketball). In other sporting events, the possibility exists of being hit or struck (e.g., a ground ball in softball). There are many such examples of athletic activities where there is a risk of impact to a breast which at the least results in bruising and at worst produces long-term injury.

With increasing involvement of women in athletics and excercise, there has been a corresponding increase in athletic wear for women, including various types of protective brassieres. However, to my knowledge, there is not available a protective brassiere which is practical, comfortable and at the same time capable of fully protecting the user's breasts from impact and injury.

This invention is directed in part to those purposes. One aspect of the invention is directed to a protective brassiere that is conventional in part, but includes unique breast portions that are formed from inner and outer fabric layers together defining a thin pocket with a lateral access opening. Disposed in each pocket is an inventive protective insert that is generally concave in shape, including a central concave portion that is substantially rigid and a peripheral portion that is at least flexible in part. The partially flexible portions generally surround the user's breast and are configured to engage and be supported by the users thoracic cage. Consequently, upon force of impact, the substantially rigid central concave portion fully protects the breast from harm, and the force is transmitted to the partially flexible peripheral portion which partly absorbs the force through flexure, while distributing the remainder to the thoracic cage.

In the preferred form of this embodiment, the protective inserts are formed from high density polyethylene, which provides the requisite rigidity for the central concave portion with partial flexibility of the peripheral portion.

The inventive protective brassiere with inventive protective inserts is particularly suited for athletic events that may involve forces imparted to the breast. The brassiere with protective inserts may also be used to advantage in industry, where protection to the breast from impact is necessary or desirable. Industrial use may be enhanced by forming the inserts from fire-retardant material.

Another aspect of the invention finds application in connection with exercise and related or similar activities, where support of the breast is of significance, but protection from impact is of lesser importance. Examples of such activities are exercise classes, aerobics, jogging, cheerleading and gymnastics. In such applications, the inventive insert may be used in a brassiere as described above or as part of an article of clothing (e.g., gymnast suit, cheerleading uniform or exercise garment), and is capable of supporting the weight of the breast and thereby relieving strain of the shoulders, back and related muscles. The insert is protective in this case in the sense that it inhibits excessive movement of the breast during prolonged and/or extensive activity.

In the supportive application, it is not essential that the central concave portion of the insert be substantially rigid as in the protective application, but it should be semirigid and therefore at least semiflexible, with the peripheral portions more flexible. Forming the insert from low density polyethylene accomplishes this purpose, while retaining the capability of fully supporting the breast in a full range of movement and activity by the user.

The full capability of the inventive protective brassiere with protective inserts and clothing article with supportive inserts will be more fully appreciated from the associated drawings and description below.

BRIEF DESCRIPTION OF THE DRAWINGS

FIG. 1 is a front elevational view of a protective brassiere for athetic/industrial use as worn by a user, and embodying the invention;

FIG. 2 is a rear elevational view of the protective brassiere as worn by a user;

FIG. 3 is an enlarged perspective view of the inventive protective brassiere, portions thereof being broken away to show protective inserts for the brassiere;

FIG. 4 is a perspective view of left and right protective inserts for the athletic/industrial brassiere and embodying the invention, the protective inserts being mirror images;

FIG. 5 is a front elevational view of the right protective insert;

FIG. 6 is a sectional view of the right protective insert as taken along the line 6—6 of FIG. 5;

DESCRIPTION OF THE PREFERRED EMBODIMENT

Figure 7:
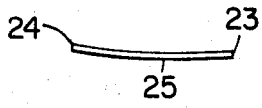
FIG. 7 is a sectional view taken along the line 7—7 of FIG. 5.
Figure 8:
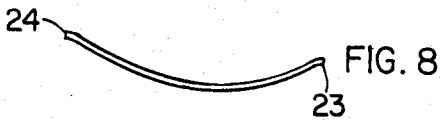
FIG. 8 is a sectional view taken along the line 8—13 8 of FIG. 5.
Figure 9:
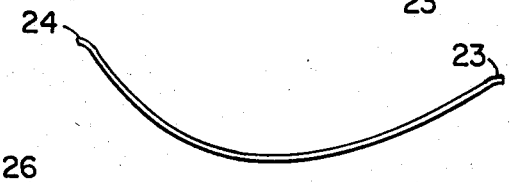
FIG. 9 is a sectional view taken along the line 9—9 of FIG. 5.
Figure 10:
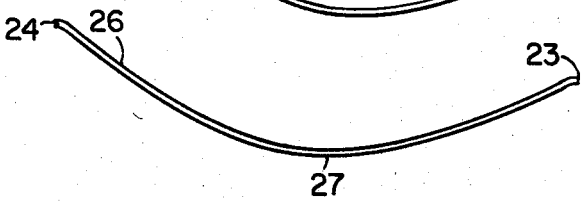
FIG. 10 is a sectional view taken along the line 10—10 of FIG. 5.

With initial reference to FIGS. 1-3, a protective brassiere embodying the invention and intended for athletic/industrial use is represented generally by the numeral 11. Brassiere 11 is to some extent conventional in construction, comprising a stretchable band 12 that encircles the thoracic cage of the user and including conventional hooking elements 13 at the back thereof (FIG. 2).

Protective brassiere 11 further comprises right and left breast portions 14R and 14L secured along their lower edges to the stretchable band 12. Stretchable shoulder straps 15, 16 each has one end connected to the right and left breast portions, respectively, and criss crossing at the back of the garment. The opposite ends of the straps 15, 16 are permanently secured to the back portion of the stretchable band 12 (FIGS. 2 and 3).

With specific reference to FIG. 3, the protective brassiere 11 is unique in that each of the breast portions 14R, 14L is of laminate form. Breast portion 14L is exemplary, comprising outer and inner fabric layers 17*a*, 17*b* that are of the same size, but may be of different fabric.

As shown in FIGS. 1 and 3, the breast portions 14R, 14L are secured to each other at the front and middle portion of the brassiere 11. The fabric layers 17*a*, 17*b* are stitched together in region, and are also stitched together at the juncture with the stretchable band 12, around the contoured armpit area and along the juncture line with the shoulder strap 16. However, along the contoured line between the shoulder strap 16 and the juncture line between the breast portions 14R, 14L, the fabric layers 17*a*, 17*b* are not stitched together. Accordingly, the layers 17*a*, 17*b* together define a thin pocket therebetween which is closed except for a lateral access opening existing in the unstitched area, and which bears the reference numeral 18. The access opening 18 is closable by a fastener which, in the preferred embodiment, is a snap 19. Other suitable fasteners could be used, including opposed strips of Velcro fastening fabric.

The construction of breast portion 14R is identical to breast portion 14L, with the exception that it is a mirror image thereof.

Protective inserts represented by the numerals 21R, 21L are removably placed in the thin pockets of breast portions 14R, 14L through access openings 18 and held in place with the snap 19. The left insert 21L in FIG. 3 is shown partially inserted into its associated pocket to show the manner of insertion. In the inserted position, the protective inserts 21R, 21L are represented by phantom lines in FIGS. 1–3.

FIG. 4 is a perspective view of the protective inserts 21R, 21L, and FIGS. 5–10 are various full and sectional views of the protective inserts 21R. A detailed description of protective insert 21R will be made for examplary purposes, but it will be appreciated that the construction of protective insert 21L is identical with the exception of its being a mirror image.

Protective insert 21R is of complex form, but generally is concave in shape, including a central concave portion and a peripheral portion described in further detail below. The central portion is irregular in shape, but generally is represented by the inner concave area of the insert that is remote from the peripheral edges.

The peripheral portion is externally defined in substantial part by three edges 22–24. Edge 22 defines a base edge for the insert 21R, extending generally straight and horizontally as viewed in FIG. 5. In the inserted position within the pocket of breast portion 14R, base edge 22 is adapted to lie under the user's breast and is engagably supported by the thoracic or rib cage of the user (the term "engage" as used herein does not mean direct engagement, due to the intervening layers of fabric and skin).

The edge 23 leads upwardly from the inside end of the base edge 22 and then contours outwardly at an angle. The lower of vertical portion as shown in FIG. 5 is adapted to overlie and receive support from the user's sternum, and the entire edge 23 is adapted to lie adjacent the inner side of the user's breast.

The edge 24 leads from the outer end of the base edge 22, rising somewhat vertically and then contouring inwardly to conform generally to the user's armpit and arm area. As such, the edge 24 lies adjacent the outer side of the user's breast.

With continued reference to FIG. 5, the edges 23, 24 converge to define an upper extension 25 of the insert 21R, which extension is protectably disposed above the user's breast. The edges 22, 24 converge to define a lateral extension 26 that extends laterally to the side of the user's thoracic cage (see also FIG. 2). The upper and lateral extensions 25, 26 respectively extend above and beyond the side of the user's breast, thus insuring that the entire breast is covered and protected, as well as adjacent areas of the body. In addition, the extensions 25, 26 assist in keeping the brassiere 11 and inserts 21R, 21L properly positioned.

With reference to FIGS. 4–6, it will be seen that a rounded flange area 27 extends along the base edge 22, curving outwardly from the concave central portion. The flange area 27 maximizes the surface area of engagement with the user's thoracic cage while at the same time providing a comfortable base of protective support.

With reference to the sectional views 7–10, it will be seen that the edges 23, 24 are also slightly rounded outwardly from the concave portion to provide comfort to the user while maximizing the area of surface contact and underlying support.

The central concave portion of protective insert 21R is substantially rigid to protect the user's breast from direct impact, but the peripheral portion is flexible at least in part to conform to the user's thoracic cage during normal circumstances, and also to flexibly absorb a part of a force imparted to the central concave portion and to distribute any remaining force to the user's thoracic cage in a comfortable, protective manner. The upper and lateral extensions 25, 26 are relatively flexible because they are of reduced width and extend away from the central concave portion, and the edges 22–24, including the flange 27, are all capable of flexure to accommodate forces to the central portion, which at all times remains substantially rigid to protect the user's breast.

In the preferred embodiment, the protective inserts 21R, 21L are formed from high density polyethylene. It has been found that, with the protective inserts 21R, 21L constructed and configured as shown in the drawings and described above, forming the inserts from high density polyethylene of a thickness of no less than about 0.060 inches and no more than about 0.090 inches will provide the requisite functions of substantial rigidity to the central concave portion and flexibility to the peripheral portion. The preferred range of thickness is 0.070–0.080 inches.

For industrial application, the inserts may be fabricated from a fire retardant material.

As is conventional, the protective brassiere 11 is provided in a number of sizes to properly fit and protect the user, and the protective inserts 21R, 21L are also provided in a number of sizes to properly fit the user.

In operation, a properly sized protective brassiere 11 is provided with properly sized inserts 21R, 21L by inserting the inserts through the access openings 18 to the thin pockets of the breast portions 14R, 14L, and securing them in place with the snaps 19. With the protective brassiere 11 worn as shown in FIGS. 1 and 2, any force of impact at the user's breast area will be received by the substantially rigid central portion of the protective insert 21R or 21L, absorbed to some extent by the flexibility of the peripheral portion of the insert, with the remainder distributed evenly and comfortably to the user's thoracic cage.

Figure 11:
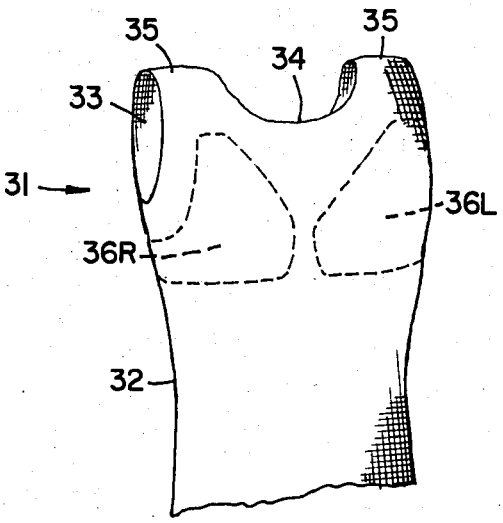
FIG. 11 is a perspective view of an article of clothing for athletics or exercise using supportive inserts.

With reference to FIG. 11, an article of clothing used for breast supportive purposes is represented generally by the numeral 31. The specific configuration of the clothing article 31 is not critical, but rather is exemplary of a garment that may be used in noncontact athletics such as gymnastics, exercise classes, aerobics, jogging and cheerleading. In the embodiment shown, the clothing article or garment 31 is formed from a suitable fabric that may or may not be provided with elasticity, depending on the requirements of the particular application.

The garment 31 is intended to fit the upper body or torso of the user, and to that end comprises a bodice 32 having arm openings 33, a neck opening 34 and shoulder portions 35.

The garment 31 is structurally similar to the brassiere 11 in that it is provided with thin pockets for supportive inserts that are formed from two layers of fabric joined together while providing an access opening. The structure of the thin pockets is not shown in FIG. 11 since it is substantially the same as that for the protective brassiere 11, although it will be appreciated that access to the thin insert pockets is from the inside of the garment 31.

Inserts 36R and 36L are shown inserted into the thin pockets of garment 31 and are represented by phantom lines in FIG. 11. The inserts 36R, 36L are configured identically to the inserts 21R, 21L of brassiere 11. However, the inserts 36R, 36L are intended to provide a supportive function rather than protecting from impact, and to that end the central portion is semirigid so that it is at least semiflexible, with the peripheral portions of the inserts 36R, 36L more flexible. These objects may be accomplished by fabricating the inserts 36R, 36L from low density polyethylene with the same thickness dimensions as described above; viz., a thickness of no less than about 0.060 inches and no more than about 0.090 inches, with a preferred range of 0.070–0.080 inches. Fabricating the inserts 36R, 37L in this manner will enable them to provide complete support of the breast in a full range of movement and activity by the user.

The inserts 21R, 21L and 36R, 37L may be used interchangeably in the brassiere 11 and garment 31, depending on the application and intended function.

What is claimed is:

1. A protective brassiere, comprising:

a fabric portion flexibly constructed to be worn by and conform to the thoracic cage of the user, the fabric portion comprising two generally concave members constructed and disposed to overlie the breasts of the user;

each of said concave members comprising two layers of fabric defining a thin pocket therebetween;

and a protective insert disposed in each of said thin pockets, each of said inserts being generally concave in shape and comprising a substantially rigid central concave portion to protect the breast from direct impact, and a peripheral portion that is flexible at least in part to conform the thoracic cage of the user and to transmit thereto forces imparted to said central concave portion.

2. The protective brassiere defined by claim 1, wherein each of said concave members further comprises an access opening to said thin pocket, and the protective insert is constructed for removable insertion in the associated thin pocket through said access opening.

3. A protective insert for a brassiere, comprising a generally concave member formed from protective material of predetermined thickness, the concave member having a central concave portion and a peripheral portion, the peripheral portion defined generally by three edges, the first of said edges defining a base edge adapted to lie under the user's breast, the second edge leading upwardly from one end of the first edge and adapted to lie adjacent the inner side of the user's breast and at least in part along the user's sternum, the third edge leading from the opposite end of the first edge and contoured to lie adjacent the outer side of the user's breast and conforming generally to the user's arm and armpit area, the second and third edges converging to define an upper extension constructed and disposed to extend above the user's breast, and the first and third edges converging to define a lateral extension constructed and disposed to extend laterally to the side of the user's thoracic cage, the central concave portion being substantially rigid to protect the user's breast from direct impact, and the peripheral portion being flexible at least in part to conform to the user's thoracic cage and to distribute thereto forces imparted to said central portion.

4. The protective insert defined by claim 3, wherein the first edge is substantially straight.

5. The protective insert defined by claim 4, which further comprises a rounded flange extending over a substantial part of the first edge, the flange curving outwardly from the concave central portion.

6. The protective insert defined by claim 3, wherein the second and third edges are at least in part rounded outwardly from the central concave portion.

7. The protective insert defined by claim 3, wherein the upper extension defined by the second and third edges is flexible.

8. The protective insert defined by claim 3, wherein the lateral extension defined by the first and third edges is flexible.

9. The protective insert defined by claim 3, wherein the protective material is high density polyethylene.

10. The protective insert defined by claim 9, wherein the high density polyethylene has a thickness of no less than about 0.060 inches and no more than about 0.090 inches.

11. The protective insert defined by claim 9, wherein the high density polyethylene has a thickness of no less than about 0.070 inches and no more than about 0.080 inches.

12. An article of clothing for breast support, comprising:

a fabric portion flexibly constructed to be worn by and conform to the thoracic cage of the user, the fabric portion comprising two regions constructed and disposed to overlie the breasts of the user;

each of said regions comprising two layers of fabric defining a thin pocket therebetween;

and a breast supporting insert disposed in each of said thin pockets, each of said inserts being generally concave in shape and comprising a central concave portion that is semiflexible to support the breast and a peripheral portion that is flexible to conform to the thoracic cage of the user.

13. The article of clothing defined by claim 12, wherein each of said regions further comprises an access opening to said thin pocket, and the protective insert is constructed for removable insertion in the associated thin pocket through said access opening.

14. The article of clothing defined by claim 12, which comprises a bodice having arm and neck openings, and the thin pockets are disposed for access internally of the bodice.

15. A breast supportive insert for an article of clothing comprising a generally concave member formed from supportive material of predetermined thickness, the concave member having a central concave portion and a peripheral portion, the peripheral portion defined generally by three edges, the first of said edges defining a base edge adapted to lie under the user's breast, the second edge leading upwardly from one end of the first edge and adapted to lie adjacent the inner side of the user's breast and at least in part along the user's sternum, the third edge leading from the opposite end of the first edge and contoured to lie adjacent the outer side of the user's breast and conforming generally to the user's arm and armpit area, the second and third edges converging to define an upper extension constructed and disposed to extend above the user's breast, and the first and third edges converging to define a lateral extension constructed and disposed to extend laterally to the side of the user's thoracic cage, the central concave portion being semiflexible to support the user's breast through a range of movement and activity, and the peripheral portion being flexible to conform to the user's thoracic age.

16. The supportive insert defined by claim 15, wherein the first edge is substantially straight.

17. The supportive insert defined by claim 16, which further comprises a rounded flange extending over a substantial part of the first edge, the flange curving outwardly from the concave central portion.

18. The supportive insert defined by claim 15, wherein the second and third edges are at least in part rounded outwardly from the central concave portion.

19. The supportive insert defined by claim 15, wherein the upper extension defined by the second and third edges is flexible.

20. The supportive insert defined by claim 15, wherein the lateral extension defined by the first and third edges is flexible.

21. The supportive insert defined by claim 15, wherein the protective material is low density polyethylene.

22. The supportive insert defined by claim 21, wherein the low density polyethylene has a thickness of no less than about 0.060 inches and no more than about 0.090 inches.

23. The supportive insert defined by claim 21, wherein the low density polyethylene has a thickness of no less than about 0.070 inches and no more than about 0.080 inches.

24. An insert for breast protection and for support for use with a garment having means for receiving and holding the insert in place, comprising a generally concave member formed from material of predetermined thickness, the concave member having a central concave portion and a peripheral portion, the peripheral portion defined generally by three edges, the first of said edges defining a base edge adapted to lie under the user's breast, the second edge leading upwardly from one end of the first edge and adapted to lie adjacent the inner side of the user's breast and at least in part along the user's sternum, the third edge leading from the opposite end of the first edge and contoured to lie adjacent the outer side of the user's breast and conforming generally to the user's arm and armpit area, the second and third edges converging to define an upper extension constructed and disposed to extend above the user's breast, and the first and third edges converging to define a lateral extension constructed and disposed to extend laterally to the side of the user's thoracic cage.

* * * * *

UNITED STATES PATENT AND TRADEMARK OFFICE

CERTIFICATE OF CORRECTION

PATENT NO. : 4,607,640

DATED : August 26, 1986

INVENTOR(S) : LeRoy H. McCusker

It is certified that error appears in the above-identified patent and that said Letters Patent is hereby corrected as shown below:

Column 2, line 40, change "8-13" to --8-8--.

Column 2, line 41, delete the numeral "8".

Column 3, line 57, change "of" to --or--.

Signed and Sealed this

Second Day of December, 1986

*Attest:*

DONALD J. QUIGG

*Attesting Officer*

*Commissioner of Patents and Trademarks*